US006997830B2

(12) United States Patent
Lin

(10) Patent No.: US 6,997,830 B2
(45) Date of Patent: Feb. 14, 2006

(54) RIDGE-EMBEDDED SOFTBALL AND BASEBALL USING THERMAL PRESSED STUFFING STRIPS

(76) Inventor: Chin-Sheng Lin, 9F-1, No. 49, Yuehyang St., Nantze Dist., Kaohsiung (TW)

( * ) Notice: Subject to any disclaimer, the term of this patent is extended or adjusted under 35 U.S.C. 154(b) by 0 days.

(21) Appl. No.: 10/852,172

(22) Filed: May 25, 2004

(65) Prior Publication Data

US 2005/0266943 A1 Dec. 1, 2005

(51) Int. Cl.
*A63B 37/12* (2006.01)

(52) U.S. Cl. ..... 473/598

(58) Field of Classification Search ..... 473/597, 473/598, 600–602

See application file for complete search history.

(56) References Cited

U.S. PATENT DOCUMENTS 415,884 A * 11/1889 Shibe ..... 473/598
1,668,969 A * 5/1928 Maynard ..... 473/598
1,861,157 A * 5/1932 Grady ..... 473/598
2,194,674 A * 3/1940 Riddell ..... 473/597
2,815,211 A * 12/1957 Grandinette ..... 473/598
5,253,865 A * 10/1993 Kinnee ..... 473/598
5,772,544 A * 6/1998 Yang ..... 473/598
6,190,273 B1 * 2/2001 Maxey et al. ..... 473/598
6,500,081 B1 * 12/2002 Chen ..... 473/598
6,666,783 B1 * 12/2003 Huang ..... 473/598

* cited by examiner

*Primary Examiner*—Steven Wong
(74) *Attorney, Agent, or Firm*—Troxell Law Office, PLLC

(57) ABSTRACT

A ridge-embedded softball or a ridge-embedded baseball in the present invention consists a spherical core, two cover pieces enclosing the core, and two threads to stitch the two pieces together. The feature of ridge-embedded softball or baseball in the present invention is that each cover piece has a stuffing strip embedded near the peripheral distal edge to create the ridges of the softball or baseball. Because the stuffing strips are firmly clamped between an outer skin and an inner fabric layer of the two cover pieces and can not squirm, the ridges are particularly and precisely defined on the softball or baseball to make the softball or baseball easily controlled during play.

4 Claims, 9 Drawing Sheets

RIDGE-EMBEDDED SOFTBALL AND BASEBALL USING THERMAL PRESSED STUFFING STRIPS

BACKGROUND OF THE INVENTION

1. Field of the Invention

The present invention relates to a novel softball or baseball, and more particularly to a novel softball or baseball having embedded ridges received inside covers of the baseball or softball using thermal pressed stuffing strips made during manufacturing of the cover pieces.

2. Description of Related Art

Typical baseballs (hardball) and softballs in accordance with the prior art each comprise a solid core and two 8-shaped covers enclosing the solid core. The two covers are made of leather and hard stitched together at edges by threads (56) to envelop the core.

With reference to FIGS. 4 to 6, a first conventional baseball (or softball) has a spherical core (50), two 8-shaped covers (52) and an 8-shaped ring pad (54). Each of the two covers (52) has an abutting peripheral portion (not numbered) to contact with one of the other cover (52). The pad (54) is engaged between the core (50) and the abutting peripheral portions of the two covers (52) and is stitched and secured to the abutting peripheral portions of the covers (52) by the threads (56). A problem of the first conventional baseball is that the pad (54) must be precisely positioned under intersecting areas between the two respectively covers (52) and the pad (54). Furthermore, when the pad (54) and the two covers (52) are stitched together, a stitching needle can cause the pad to slightly squirm out of place when inserted, thereby, adversely affecting the overall uniformity and balance of the baseball. Softballs or baseballs, which are not properly balanced, can not be precisely controlled to be thrown by pitchers and are rejected in organized softball or baseball games. Such rejection would lead to loss of confidence by game officials in a manufacturer.

To overcome the drawbacks of the first conventional softball (baseball), a second conventional softball (baseball) is disclosed as shown in FIGS. 7 to 9. The second conventional softball (baseball) comprises a spherical core (60) and two covers (62). Each of the two covers (62) is formed approximately 8-shaped and has a peripheral edge (622) folded under. When the two covers (62) envelop the core (60), two threads (66) are stitched on the two covers (62) around the peripheral edges (622) in an intersecting mating pattern to combine the two covers (62) together. Wherein, ridges of the softball (baseball) are created by the folded peripheral edges (622) to make the softball (baseball) easily grabbed and controlled when the softball (baseball) is thrown. However, the softball (baseball) is uneven at joints because the peripheral edges (622) directly folded inward to an under side of the cover (62) must have surplus portions to be stuffed between the covers (62) and the core (60) since the peripheral edges of the covers (62) are larger than an inner area of the under side in length. Therefore, it is difficult to stitch covers of the second conventional softball (baseball) together and is still uneven such that the finished ball can not satisfy strict quality requirements in of official softball or baseball games.

The present invention has arisen to mitigate or obviate the disadvantages of the conventional softball or baseballs.

SUMMARY OF THE INVENTION

The main objective of the present invention is to provide a ridge-embedded softball or baseball that is even and has a uniform pattern of ridges to reach softball or baseball standard.

Further benefits and advantages of the present invention will become apparent after a careful reading of the detailed description with appropriate reference to the accompanying drawings.

DETAILED DESCRIPTION OF THE PREFERRED EMBODIMENT

A ridge-embedded softball or a ridge-embedded baseball in accordance with the present invention comprises a spherical core, two cover pieces enclosing the core, and two threads to stitch the two cover pieces together. The feature of ridge-embedded softball or baseball in the present invention is that each piece of the two cover pieces has a stuffing strip embedded near the peripheral distal edge to create the ridges of the softball or baseball. Because the stuffing strips are firmly clamped between an outer skin and an inner fabric layer and can not squirm, the ridges are particularly and precisely defined on the softball or baseball to make the softball or baseball easily controlled.

Figure 1:
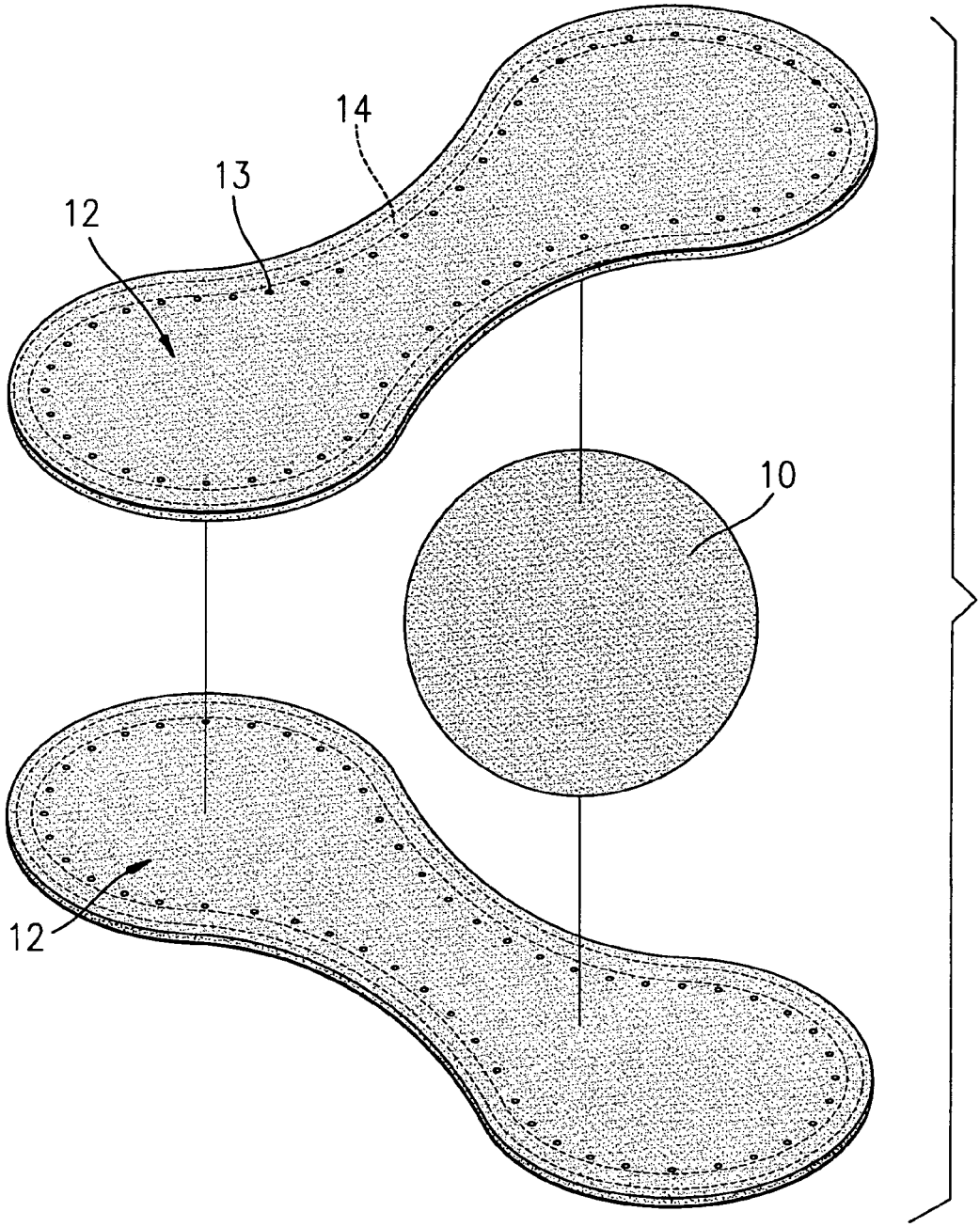
FIG. 1 is an exploded perspective view of a ridge-embedded softball or baseball in accordance with the present invention.
Figure 2:
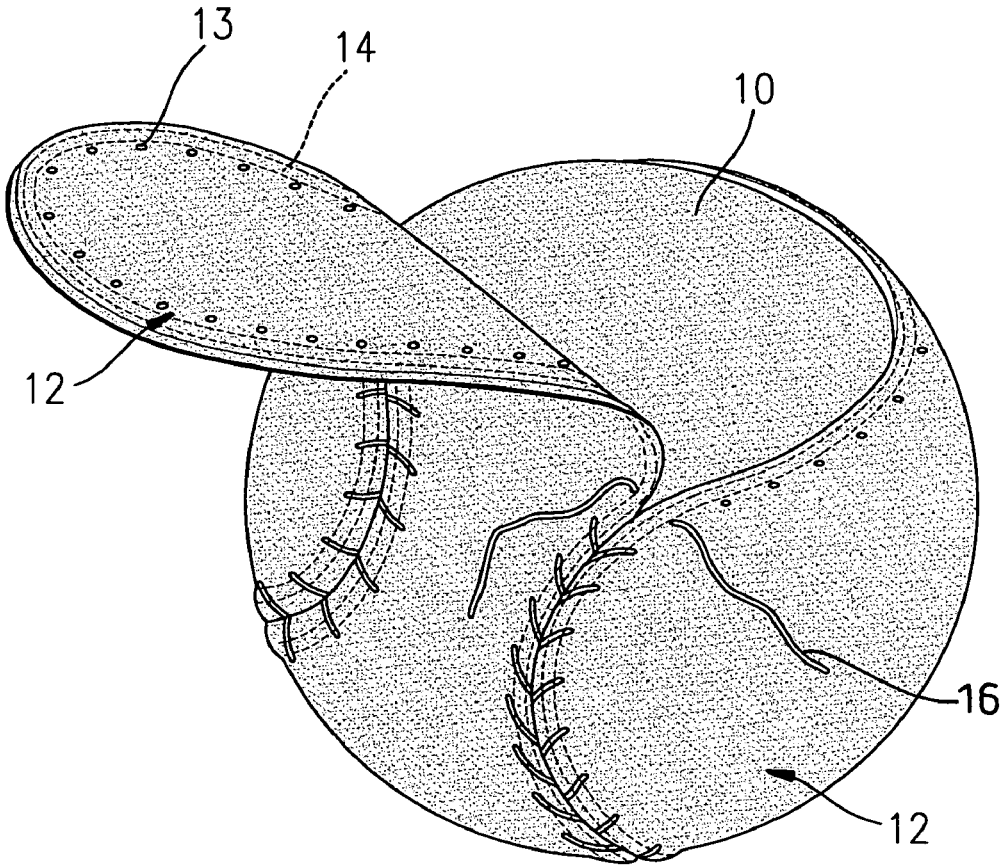
FIG. 2 is a perspective view of the ridge-embedded softball or baseball in FIG. 1, wherein the ridge-embedded softball or baseball is assembled.
Figure 3:
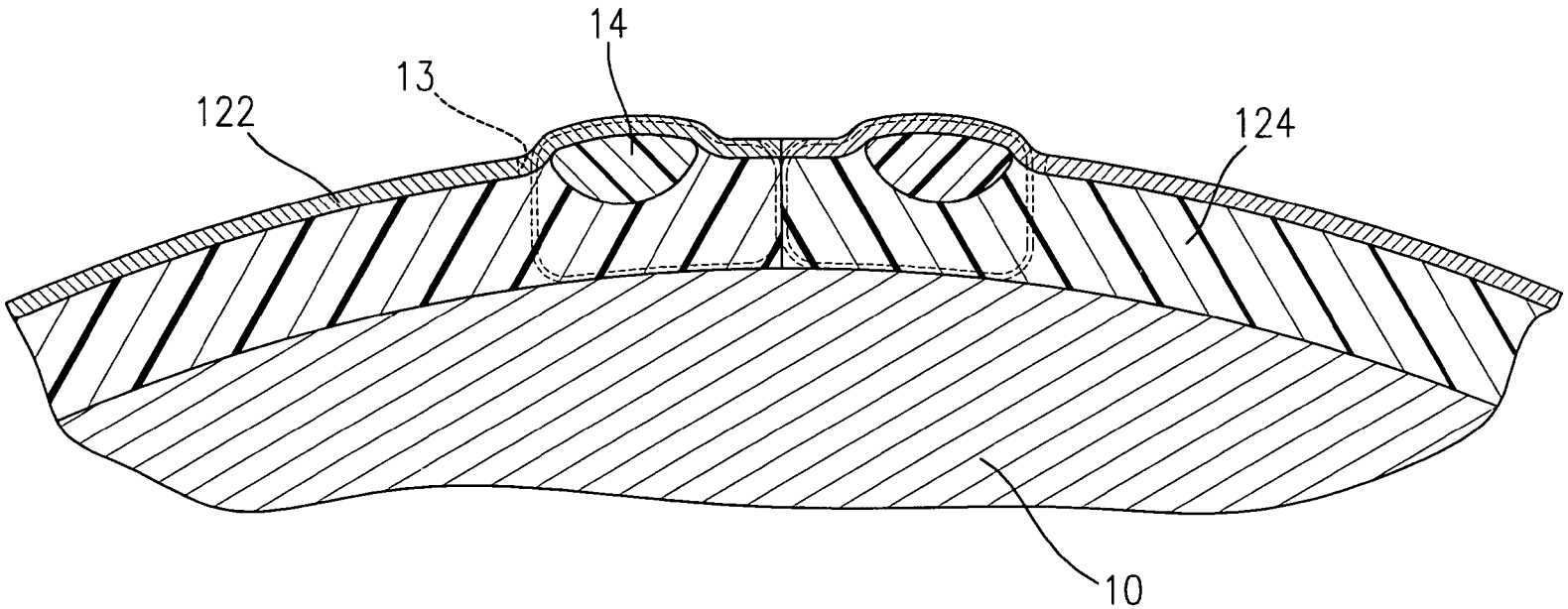
FIG. 3 is a side plane view in partial cross-section of the ridge-embedded softball or baseball in FIG. 2.
Figure 4:
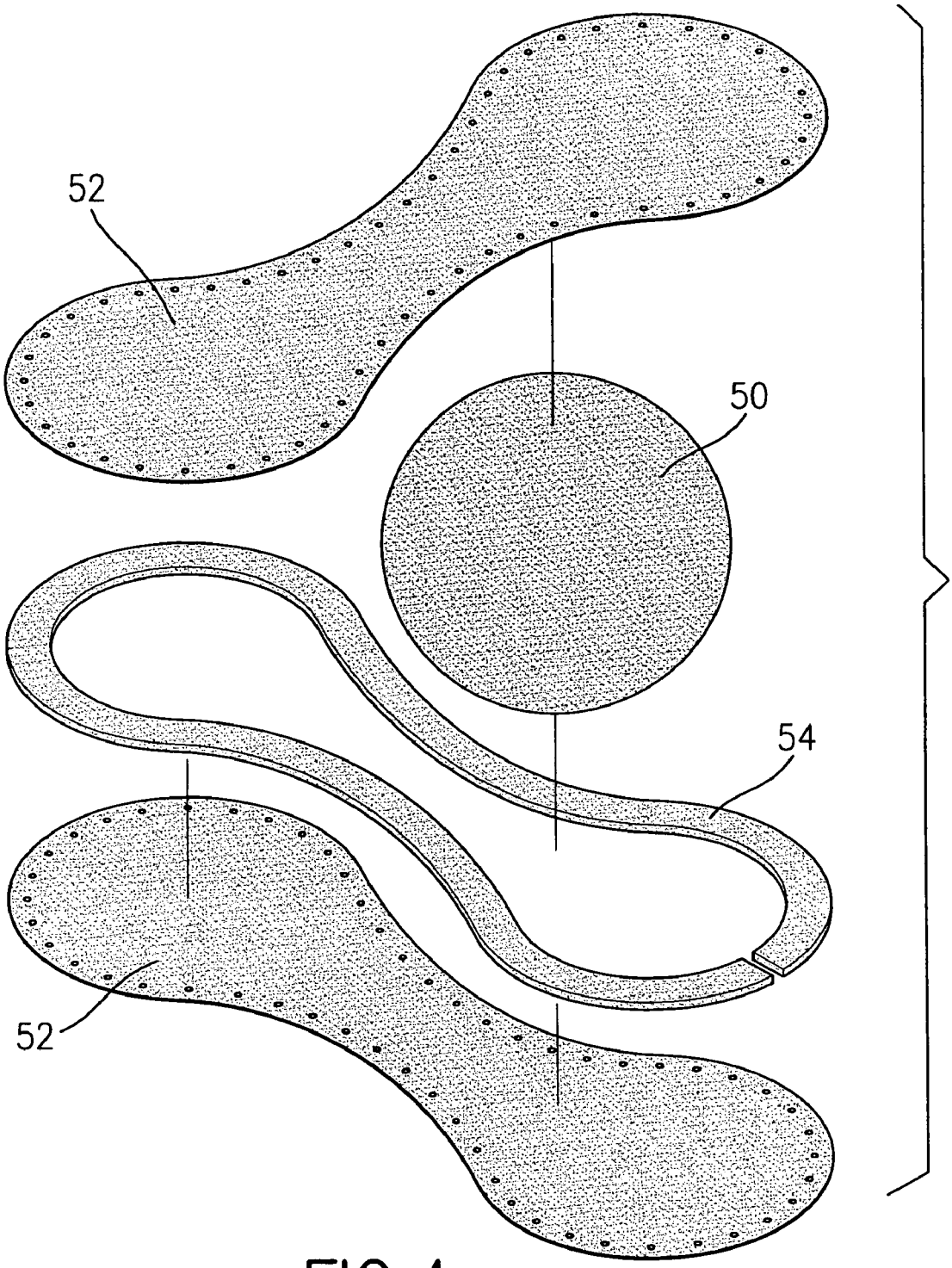
FIG.4 PRIOR ART
FIG. 4 is an exploded perspective view of a first conventional softball or baseball in accordance with the prior art.
Figure 5:
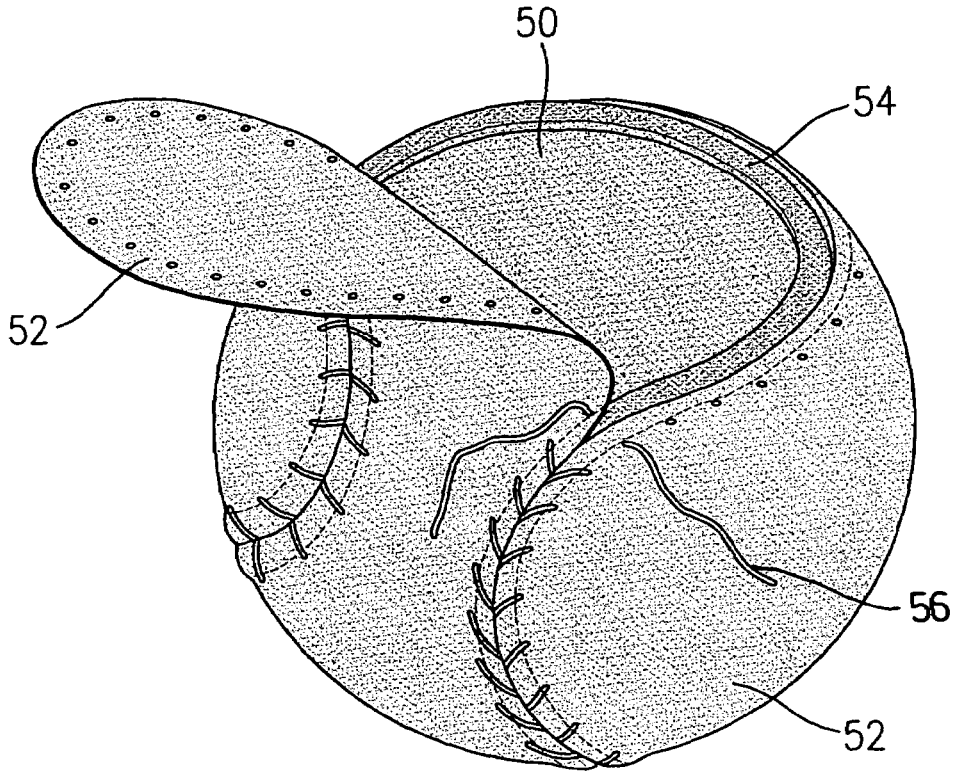
FIG.5 PRIOR ART
FIG. 5 is a perspective view of the first conventional softball or baseball in FIG. 4, wherein the first conventional softball or baseball is assembled.
Figure 6:
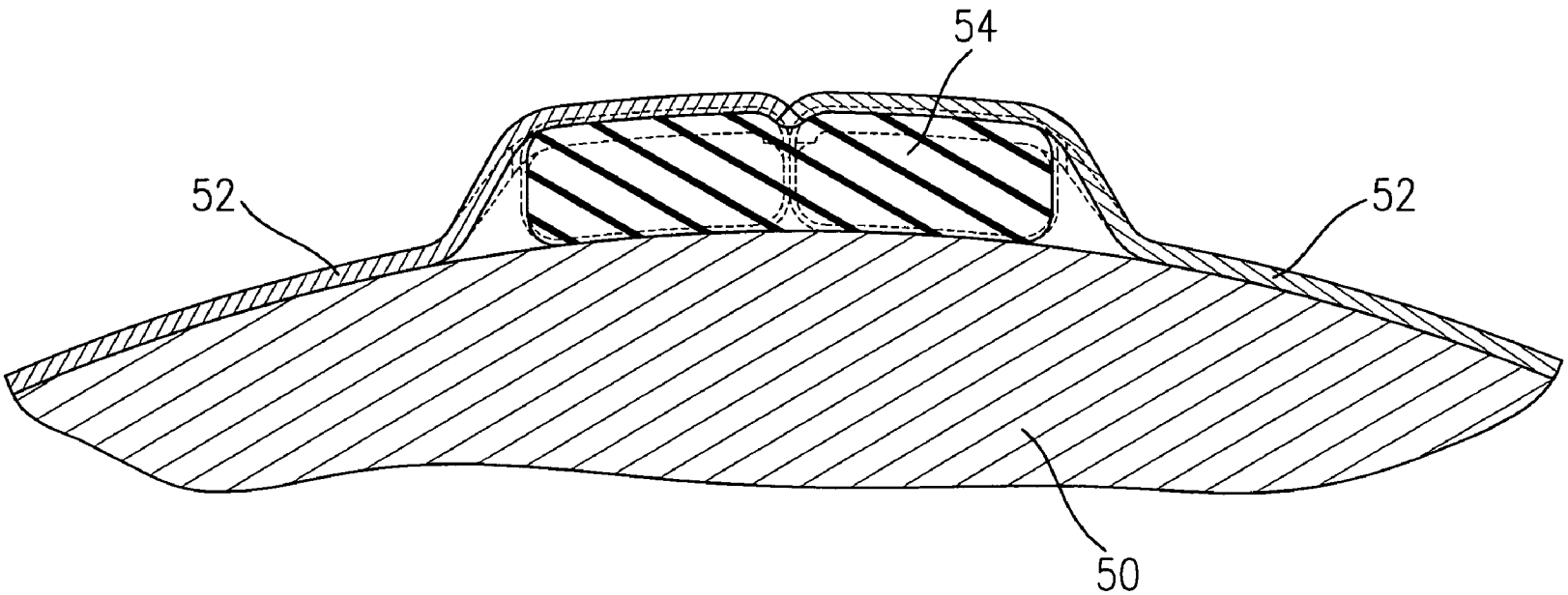
FIG. 6 PRIOR ART
FIG. 6 is a side plane view in partial cross-section of the first conventional softball or baseball in FIG. 5.
Figure 7:
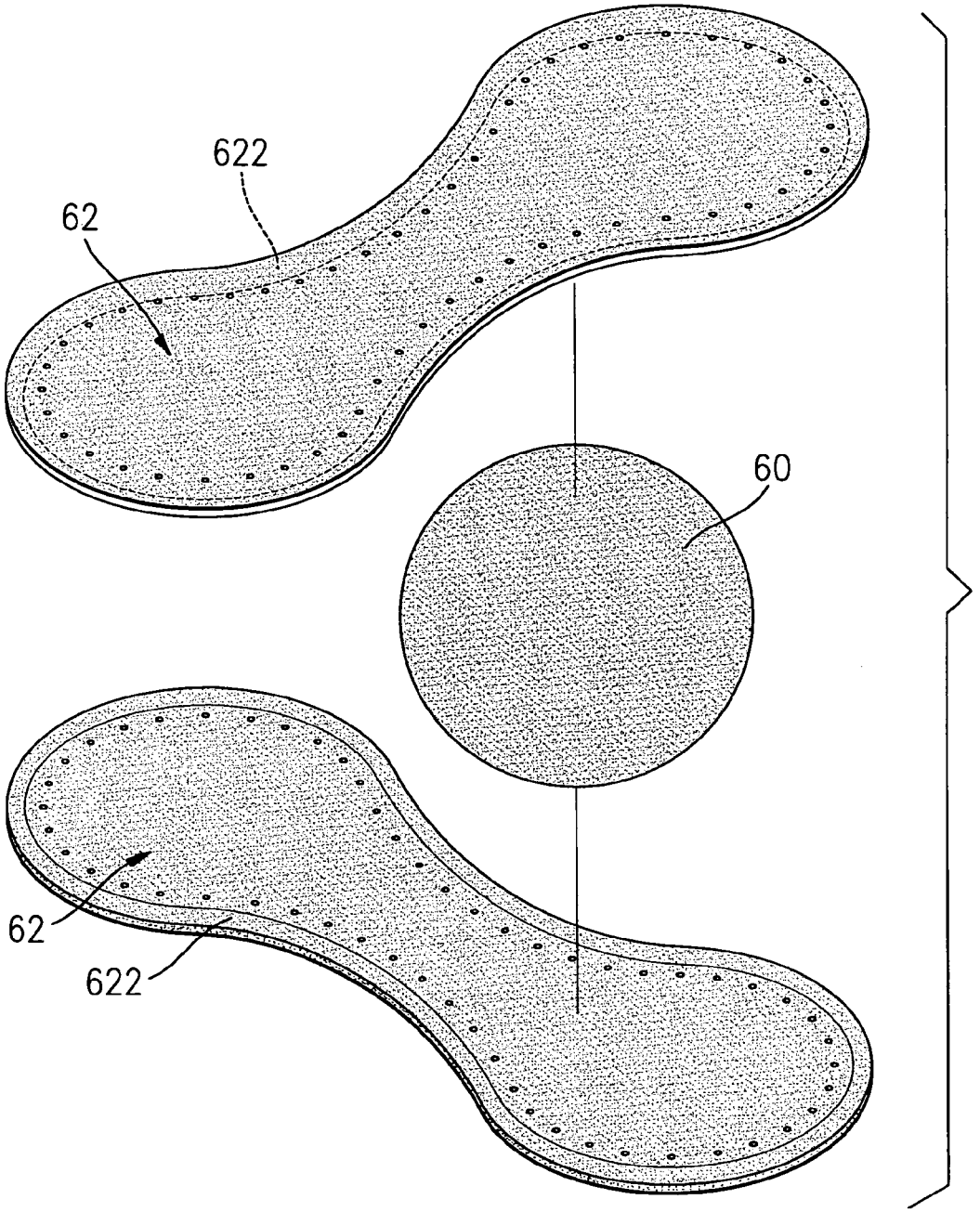
FIG.7 PRIOR ART
FIG. 7 is an exploded perspective view of a second conventional softball or baseball in accordance with the prior art.
Figure 8:
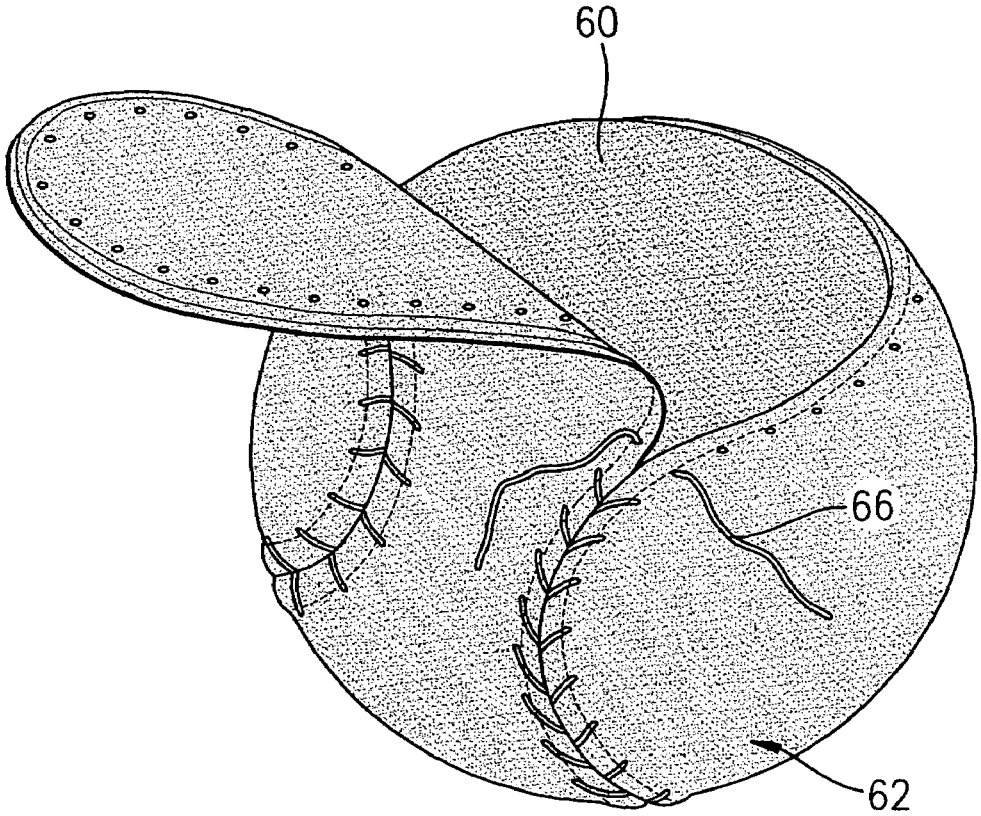
FIG.8 PRIOR ART
FIG. 8 is a perspective view of the second conventional softball or baseball in FIG. 7, wherein the first conventional softball or baseball is assembled.
Figure 9:
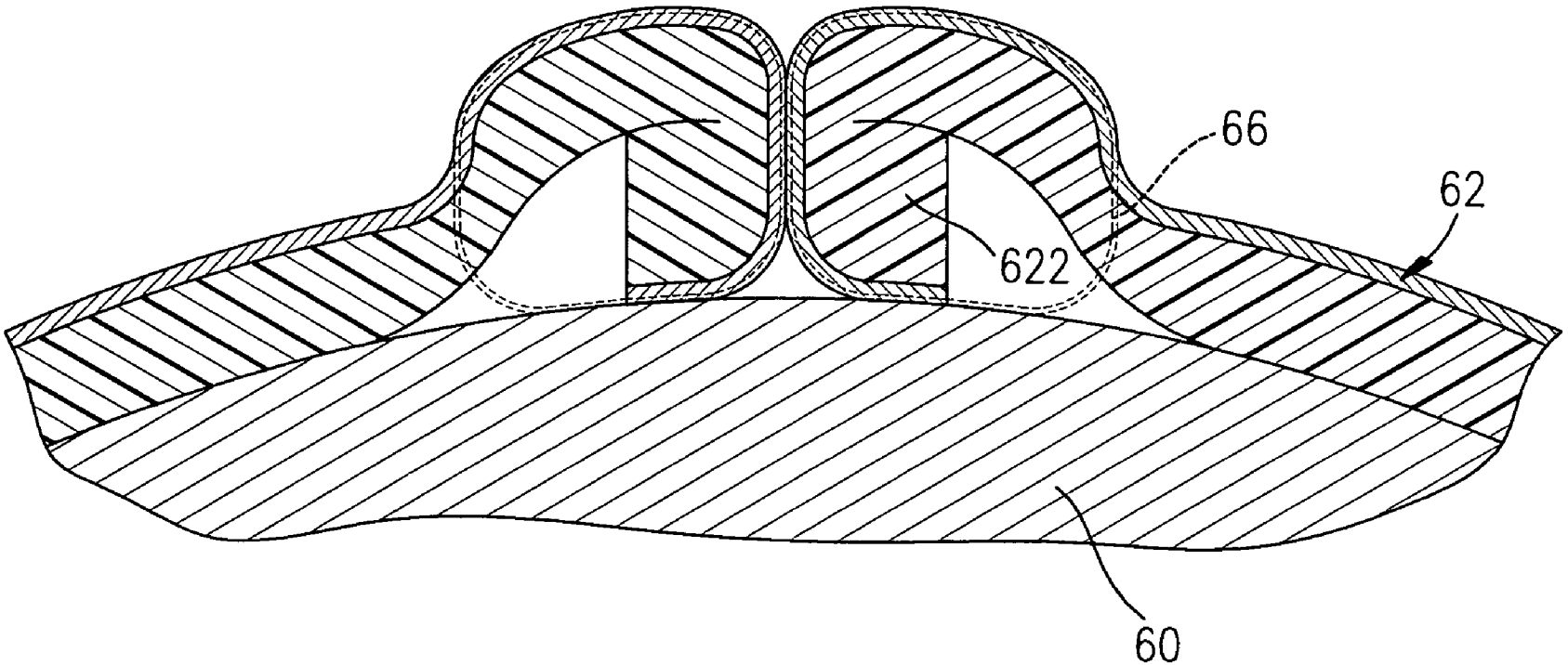
FIG.9 PRIOR ART
FIG. 9 is a side plane view in partial cross-section of the second conventional softball or baseball in FIG. 8.

With reference to FIGS. 1, 2 and 3, a preferred embodiment of the ridge-embedded softball or baseball in accordance with the present invention comprises a peripheral core (10) with an outer periphery, two 8-shaped cover pieces (12) with embedded stuffing strips (14) and two threads (16).

The two 8-shaped cover pieces (12) are engaged on the outer periphery of the periphery core (10) and each has a peripheral distal edge (not numbered) and a series of thread holes (13). The two 8-shaped cover pieces (12) are stitched together along the peripheral distal edges by the two threads (16) intersecting and weaving alternately extended through the 8-shaped cover pieces (12) in a double-helix manner through the thread holes (13).

Characteristics of the ridge-embedded softball or baseball of the present invention are that each 8-shaped cover piece (12) has an outer skin (122), an inner fabric layer (124) and a stuffing strip (14) mounted between the outer skin (122) and the inner fabric (124) to create the ridge of the softball or baseball. The stuffing strip (14) extends along and near the peripheral distal edge and is firmly combined with the outer skin (122) and the inner fabric layer (124) by thermal pressing during manufacturing of the cover piece (12). Therefore, once the stuffing strip (14) is clamped between the outer skin (122) and the inner fabric layer (124), the stuffing strip (14) is immovable so that the ridge of the softball or baseball remains uniform after stitching or impact during a game.

In comparison with the first and second conventional softball or baseballs, the ridge-embedded softball or baseball of the present invention has the following advantages:

1. The pad (54) of the first conventional softball or baseball is not necessary under the two covers (52). With the embedded stuffing strips (14) in the two cover pieces (12), the ridges are fixed and cannot move out of position when the two cover pieces (12) are stitched together to envelop the spherical core (10). The consistency of the softball or baseball is uniform and quality of the softball or baseball is acceptable to softball or baseball authorities.

2. The uneven surface as shown in the second conventional softball or baseball is avoided. Because the stuffing strips (14) are smoothly mounted between the outer skin (122) and the inner fabric layer (124) of the cover pieces (12), the surplus that experienced in the second conventional softball or baseball is avoided. Therefore, the surface of the ridge-embedded softball or baseball in the present invention is even and smooth and makes the stitching easy.

Although the invention has been explained in relation to its preferred embodiment, it is to be understood that many other possible modifications and variations can be made without departing from the spirit and scope of the invention as hereinafter claimed.

What is claimed is:

1. A ridge-embedded ball comprising:

a) a core;

b) two cover pieces covering an outer periphery of the core and having a plurality of thread holes located around a peripheral edge thereof, each of the two cover pieces having:

i) an outer skin;

ii) an inner fabric layer aligning with the outer skin; and iii) a stuffing strip located between and integrally fixed to the peripheral edge of the outer skin and the peripheral edge of the inner fabric layer; and c) two threads intersecting and connecting a peripheral edge of a first cover piece of the two cover pieces to a peripheral edge of a second cover piece of the two cover pieces.

2. The ridge-embedded ball according to claim 1, wherein the two cover pieces are 8-shaped cover pieces, and the two threads are alternatingly inserted through the plurality of holes in the two cover pieces creating a double-helix pattern.

3. The ridge-embedded ball according to claim 1, wherein the stuffing strip is connected between the outer skin and the inner fabric layer by thermal pressure.

4. The ridge-embedded ball according to claim 2, wherein the stuffing strip is connected between the outer skin and the inner fabric layer by thermal pressure.

* * * * *